US010559439B2

(12) United States Patent
Ishihara

(10) Patent No.: US 10,559,439 B2
(45) Date of Patent: Feb. 11, 2020

(54) ROCKER SWITCH DEVICE

(71) Applicant: KABUSHIKI KAISHA TOKAI RIKA DENKI SEISAKUSHO, Aichi (JP)

(72) Inventor: Akito Ishihara, Aichi (JP)

(73) Assignee: KABUSHIKI KAISHA TOKAI RIKA DENKI SEISAKUSHO, Aichi-Ken (JP)

( * ) Notice: Subject to any disclaimer, the term of this patent is extended or adjusted under 35 U.S.C. 154(b) by 0 days.

(21) Appl. No.: 15/887,302

(22) Filed: Feb. 2, 2018

(65) Prior Publication Data

US 2018/0226212 A1 Aug. 9, 2018

(30) Foreign Application Priority Data

Feb. 7, 2017 (JP) ..... 2017-020398

(51) Int. Cl.

| | |
|---|---|
| ***H01H 23/00*** | (2006.01) |
| ***H01H 23/04*** | (2006.01) |
| ***H01H 23/08*** | (2006.01) |
| ***H01H 23/14*** | (2006.01) |
| ***H01H 21/22*** | (2006.01) |

(Continued)

(52) U.S. Cl.

CPC ..... *H01H 23/145* (2013.01); *H01H 1/26* (2013.01); *H01H 21/22* (2013.01); *H01H 21/24* (2013.01); *H01H 23/00* (2013.01); *H01H 23/04* (2013.01); *H01H 23/08* (2013.01);

(Continued)

(58) Field of Classification Search

CPC ..... H01H 2300/01; H01H 2021/225; H01H 23/00; H01H 23/03

See application file for complete search history.

(56) References Cited

U.S. PATENT DOCUMENTS 6,054,655 A * 4/2000 Rudolph ..... H01H 19/635 200/1 B
7,507,923 B2 * 3/2009 Azizi ..... H01H 23/003 200/295

(Continued)

FOREIGN PATENT DOCUMENTS

CN 103295821 A 9/2013
CN 104637721 A 5/2015

(Continued)

OTHER PUBLICATIONS

European Search Report issued in related Application No. 18155449.4-1204 dated Jun. 26, 2018; 4 pages.

(Continued)

*Primary Examiner* — Vanessa Girardi
(74) *Attorney, Agent, or Firm* — Roberts Mlotkowski Safran Cole & Calderon P.C.

(57) ABSTRACT

A rocker switch device includes an operation knob with a close bottom cylindrical shape configured to be operated, a body including a contact point configured such that current is interruptible by the operation knob and a support portion that projects toward an inside of the operation knob and supports the operation knob in a manner allowing for rocking, and a projection portion that projects from a portion of a surface of the support portion of the body that opposes the operation knob or a portion of a surface of the operation knob that opposes the body toward an opposing member.

6 Claims, 2 Drawing Sheets

(51) Int. Cl.
*H01H 21/24* (2006.01)
*H01H 1/26* (2006.01)

(52) U.S. Cl.
CPC . *H01H 2021/225* (2013.01); *H01H 2221/016* (2013.01); *H01H 2300/01* (2013.01)

(56) References Cited

U.S. PATENT DOCUMENTS

| | | | |
|---|---|---|---|
| 10,083,803 | B2 | 9/2018 | Takeuchi |
| 2010/0219055 | A1 | 9/2010 | Wada et al. |
| 2015/0129405 | A1 | 5/2015 | Takeuchi |

FOREIGN PATENT DOCUMENTS

| | | | |
|---|---|---|---|
| CN | 205050747 | U | 2/2016 |
| EP | 1691386 | A2 | 8/2006 |
| EP | 1748452 | A1 | 1/2007 |
| JP | 61190641 | U | 11/1986 |
| JP | 2013-225390 | A | 10/2013 |

OTHER PUBLICATIONS

Office Action dated Mar. 27, 2018 in the corresponding Japanese Application No. 2017-020398.
Office Action issued in corresponding European Application No. 18155449.4 dated Jun. 18, 2019.

* cited by examiner

ROCKER SWITCH DEVICE

BACKGROUND

Technical Field

The present invention relates to a rocker switch device.

Related Art

An example of a known rocker switch device is a seesaw switch device used as a power window switch in an automobile (see JP 2013-225390 A, for example).

The seesaw switch device described in the aforementioned JP 2013-225390 A includes an operation knob with a bottomed cylindrical shape capable of rocking in a pulling-up direction and a pushing-down direction about support shafts projecting from the sides of a left-right pair of support portions disposed upright on a case. The operation knob is attached to the case in a manner allowing for rocking by bringing the holes on the left and right sides of the operation knob close to the left-right pair of support portions from above and fitting the support shafts of the support portions into the holes of the operation knob.

SUMMARY

Such a seesaw switch device switches from on to off via the pulling-up operation and the pushing-down operation of the operation knob. When the operation knob is pulled up and operated in an inclined orientation, the holes of the operation knob becomes misaligned with the direction of the support shafts of the support portions and the operation knob may detach.

Thus, an object of an aspect of the invention is to provide a rocker switch device capable of suppressing detachment of an operation knob.

An aspect of the invention provides a rocker switch device comprising:

- an operation knob with a close bottom cylindrical shape configured to be operated;
- a body including a contact point configured such that current is interruptible by the operation knob and a support portion that projects toward an inside of the operation knob and supports the operation knob in a manner allowing for rocking; and
- a projection portion that projects from a portion of a surface of the support portion of the body that opposes the operation knob or a portion of a surface of the operation knob that opposes the body toward an opposing member.

The projection portion is preferably disposed at a plurality of positions.

The projection portion is preferably disposed on both sides of a rocking axis line of the operation knob.

The support portion of the body may comprise an engagement portion to engage with the operation knob, and wherein the projection portion may be disposed outside of the engagement portion.

The projection portion may comprise a linear portion formed parallel to a longitudinal direction of the body.

The linear portion may extend from a bottom end to a top end of the support portion of the body.

The operation knob is preferably configured to rock via a pulling-up operation and a pushing-down operation.

According to an aspect of the invention, a rocker switch device with a function that reduces detachment of the operation knob can be obtained.

DESCRIPTION OF EMBODIMENTS

A rocker switch device according to embodiments will be described below with reference to the accompanying drawings.

An example of a rocker switch device according to an embodiment is a power window switch device that is a momentary switch with functions including a raising operation (manual operation), automatic raising operation (auto operation), lowering operation (manual operation), and automatic lowering operation (auto operation) of windows of a vehicle.

Figure 1:
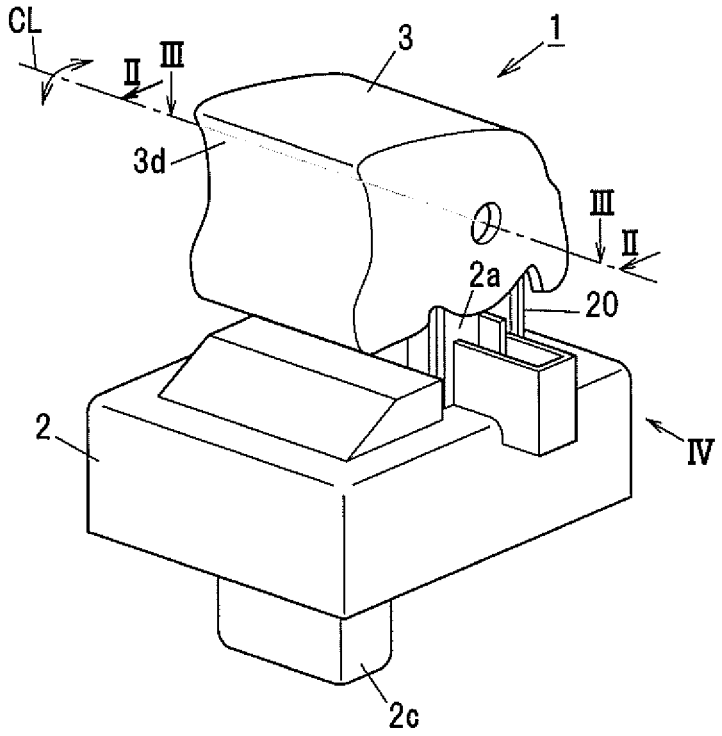
FIG. 1 is a perspective view schematically illustrating an example of a rocker switch device according to an embodiment.

As illustrated in FIG. 1, a rocker switch device 1 includes a switch body 2 shaped as a case attachable to inward-projecting vehicle interior components such as a door armrest and an operation knob 3 disposed on an upper surface of the switch body 2 in a manner allowing for rocking. The switch body 2 and the operation knob 3 are made of a resin material such as ABS resin.

Figure 2:
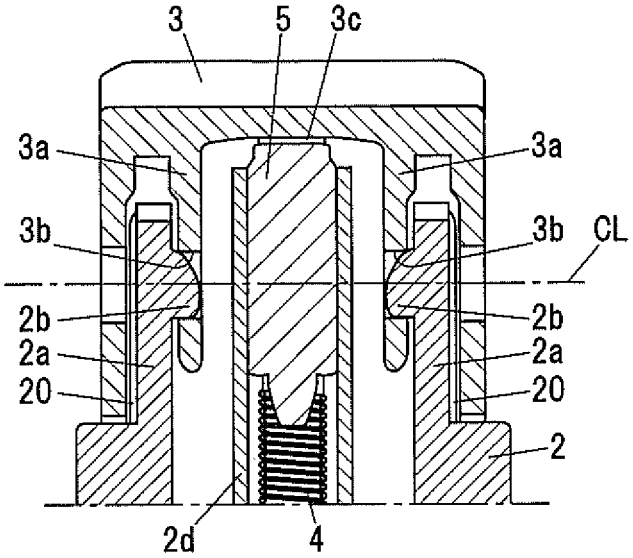
FIG. 2 is an enlarged cross-sectional view of a main portion, as viewed in the direction of the arrows of line II-II of FIG. 1.

As illustrated in FIGS. 1 and 2, a left-right pair of support portions 2*a*, 2*a* are disposed upright on the upper surface of the switch body 2 extending upward. The support portions 2*a*, 2*a* are configured to allow the operation knob 3 to rock in the pulling-up direction and the pushing-down direction. The support portions 2*a*, 2*a* are provided with shaft portions 2*b*, 2*b* that project inward toward one another.

The operation knob 3 is constituted by a shell with a bottomed cylindrical shape in which the four inner surfaces of the cylindrical portion in the front-back and left-right directions are formed and an internal bottom face opens. A finger operated operation receiving portion 3*d* of the operation knob 3 tapers as it extends from the opening end portion toward the front end portion.

Attachment portions 3*a*, 3*a* are disposed upright on the internal bottom face of the cylindrical portion of the operation knob 3 and supported by the left-right pair of support portions 2*a*, 2*a* of the switch body 2. The attachment portions 3*a*, 3*a* are configured to plastically deform.

A shaft bearing portion 3*b* is formed on each attachment portions 3*a* of the operation knob 3. By the shaft bearing portion 3*b* of the attachment portion 3*a* of the operation knob 3 engaging and snap fitting together with the shaft portion 2*b* of the support portion 2*a* of the switch body 2, the operation knob 3 is supported by the switch body 2 in a manner allowing for rocking.

A pressure switch mechanism (not illustrated) is provided inside the switch body 2. The pressure switch mechanism has an on/off switching configuration actuated by the rocking operation of the operation knob 3 in the pulling-up direction or the pushing-down direction about a rocking axis line CL that runs through the center of the shaft portion 2*b* of the support portion 2*a*. A connector 2*c* for connecting the pressure switch mechanism to an external control device or the like extends downward from the switch body 2.

A known pressure switch mechanism including a fixed contact disposed inside the switch body 2 and a moving contact whose contact/separated state with the fixed contact depending on the rocking operation of the operation knob 3 determines the on/off state can be used as the pressure switch mechanism.

A cylindrical slide guide 2*d* is disposed upright between the left-right pair of support portions 2*a*, 2*a* of the switch body 2. The slide guide 2*d* accommodates a coil spring 4. A slide 5 is disposed on the upper end of the coil spring 4 accommodated inside the cylindrical portion of the slide guide 2*d*. The slide 5 is supported by the slide guide 2*d* in a manner allowing for sliding movement in the vertical direction.

The upper end portion of the slide 5 is, in a neutral position, pushed against a slide groove 3*c* formed on the internal bottom face of the operation knob 3 via the spring bias of the coil spring 4 so as to be brought in contact in a manner allowing for sliding movement. When the slide 5 is at rest in the neutral position of the slide groove 3*c*, the operation knob 3 is supported in its initial position.

When the operation knob 3 is operated in a rocking manner in the pulling-up direction or pushing-down direction, the slide 5 slides relative to the slide groove 3*c* and is pushed downward against the spring bias of the coil spring 4. Such movement of the operation knob 3 switches the pressure switch mechanism on.

When the rocking operation of the operation knob 3 is ceased, the restoring force of the coil spring 4 pushes the slide 5 upward. By the slide 5 sliding relative to the slide groove 3*c*, the operation knob 3 is automatically returned to the original initial position, turning the pressure switch mechanism off.

As described above, the shaft bearing portions 3*b*, 3*b* of the left and right pair of attachment portions 3*a*, 3*a* of the operation knob 3 and the shaft portions 2*b*, 2*b* of the left and right support portions 2*a*, 2*a* of the switch body 2 are snap fit attached to one another. With this structure, the shaft bearing portions 3*b*, 3*b* of the operation knob 3 becomes misaligned from the direction of the shaft portions 2*b*, 2*b* of the switch body 2, especially when the operation knob 3 is pulled up and operated in an inclined orientation. Accordingly, the shaft bearing portion 3*b* of the operation knob 3 may detach from the shaft portion 2*b* of the switch body 2. Additionally, in a case that the shaft portion 2*b* of the support portion 2*a* or the shaft bearing portion 3*b* of the operation knob 3 are damaged, the shaft bearing portion 3*b* of the operation knob 3 may detach from the shaft portion 2*b* of the switch body 2.

In light of this, projection portions 20 to prevent detachment are disposed on the surface of the support portion 2*a* of the switch body 2 opposing the operation knob 3 or on the surface of the operation knob 3 opposing the support portion 2*a*. The projection portions 20 restrict the movement of the operation knob 3 in the rocking axis line CL so that the shaft bearing portion 3*b* of the operation knob 3 does not disengage with the shaft portion 2*b* of the switch body 2.

Figure 3:
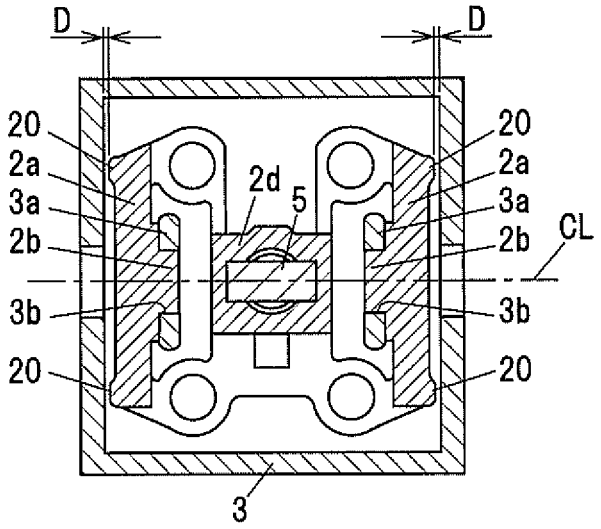
FIG. 3 is an enlarged cross-sectional view of a main portion, as viewed in the direction of the arrows of line III-III of FIG. 1.
Figure 4:
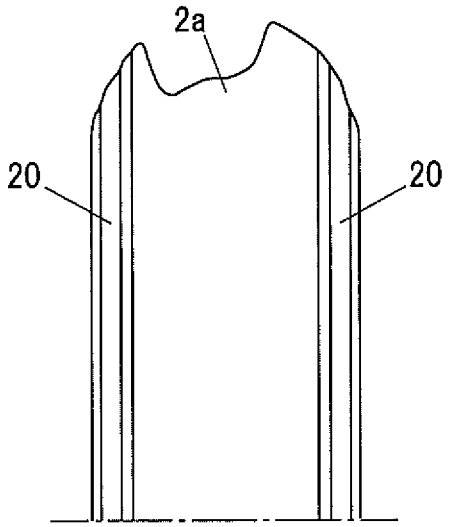
FIG. 4 is an enlarged view of a support portion of an operation knob used in a rocker switch device according to an embodiment, as viewed in the direction of the arrow of the line IV of FIG. 1.

As illustrated in FIGS. 2, 3, and 4, the projection portions 20 are disposed on the surface of the support portions 2*a*, 2*a* of the switch body 2 opposite the side where the shaft portions 2*b*, 2*b* are formed. The projection portions 20 are disposed on either side of the rocking axis line CL on the support portion 2*a* and extend in the vertical direction.

A predetermined gap dimension D is set between the inner surface of the cylindrical portion of the operation knob 3 and the projection portions 20 of the switch body 2. When the operation knob 3 is operated in a rocking manner in an inclined orientation with respect to the rocking axis line CL, the projection portions 20 can come into contact with the inner surface of the cylindrical portion of the operation knob 3. This decreases the gap dimension D. The gap closing in this manner restricts the movement of the operation knob 3 in the rocking axis line CL to the gap dimension D.

Such a configuration can restrict the movement of the operation knob 3 in a misaligned direction even when a rocking operation in the pulling-up direction results in the operation knob 3 being pulled up with the shaft bearing portion 3*b* of the operation knob 3 being inclined with respect to the shaft portion 2*b* of the switch body 2. Accordingly, the operation knob 3 can be prevented from detaching from the switch body 2.

Note that the projection portions 20 have a shape that projects out from the surface of the support portion 2*a* of the switch body 2 and may be a pin-like or rib-like projection, a long, thin rib-like or columnar projection, or other similar shapes.

Here, an embodiment in which the projection portions 20 are disposed on the support portion 2*a* of the switch body 2 has been described. However, in another embodiment, the projection portions 20 may be disposed at discretionary position on either side of the rocking axis line CL on the surface of the support portion 2*a* of the switch body 2 opposing the operation knob 3 or the surface of the operation knob 3 opposing the support portion 2*a*.

Additionally, the number of projection portions 20 is not limited to two and may be one or three or greater.

Furthermore, the portion where the projection portion 20 comes into contact with the operation knob 3 may experience line contact or surface contact, and such line contact and surface contact may be of an intermittent nature.

Furthermore, the shaft bearing portion 3*b* of the operation knob 3 may be a through-hole, a recessed portion, or a similar configuration.

Furthermore, an embodiment in which the shaft portion 2*b* provided on the switch body 2 engages with the shaft bearing portion 3*b* of the operation knob 3 has been described.

However, in another embodiment, the relationship between the shaft portion 2*b* and the shaft bearing portion 3*b* may be reversed.

The rocker switch device 1 with the configuration described above includes the pair of support portions 2*a*, 2*a* provided on the switch body 2, the operation knob 3 attached to the support portions 2*a*, 2*a* in a manner allowing for rocking in the pulling-up direction and the pushing-down direction, and the projection portion 20 disposed on the surface of the support portion 2*a* of the switch body 2 opposing the operation knob 3 or the surface of the operation knob 3 opposing the support portion 2*a*. The projection portion 20 is configured to be brought into contact with the operation knob 3 when the operation knob 3 is operated in a rocking manner in an inclined orientation with respect to the rocking axis line CL and restrict movement in a direction in which the operation knob 3 would be detached from the switch body 2.

The rocker switch device 1 of the embodiments illustrated in the drawings includes the pair of support portions 2*a*, 2*a* disposed upright on the upper surface of the switch body 2 and the pair of attachment portions 3*a*, 3*a* disposed upright on the internal bottom face of the operation knob 3 with a bottomed cylindrical shape. The pair of support portions 2*a*, 2*a* each include the shaft portion 2*b* formed projecting toward one another on opposing surfaces. The pair of attachment portions 3*a*, 3*a* include the shaft bearing portions 3*b* configured to fit in the shaft portions 2*b*, 2*b* and engage in a manner allowing for rocking. The projection portion 20 is provided on the surface of the support portion 2*a* on the side opposite where the shaft portion 2*b* is formed.

The projection portion 20 is preferably formed as a projection on either side of the rocking axis line CL of the operation knob 3 and extends in the vertical direction.

The projection portion 20 is preferably formed as a projection that is a gap closing portion for reducing the gap dimension D between the support portion 2*a* of the switch body 2 and the operation knob 3.

According to such a rocker switch device 1, the following effects in addition to those described above can be obtained.

Because the rigidity of the engaging portion between the operation knob 3 and the switch body 2 does not need to be increased, the engaging load that acts on the engaging portion between the switch body 2 and the operation knob 3 can be reduced.

As made clear above, the invention according to the scope of the claims is not limited by the representative embodiments and illustrated examples according to the invention described above. As such, it should be understood that all combinations of the features described in the embodiments and illustrated examples are not required parts of the means to solve the problems of the invention.

The invention claimed is:

1. A rocker switch device, comprising:

a hollow operation knob;

a body configured such that current is interruptible by the operation knob and a support portion that projects toward an inside of the operation knob and supports the operation knob in a manner allowing for rocking;

a shaft portion that projects toward and engages a shaft bearing portion, the shaft portion projecting from one of the support portion and the operation knob, the shaft bearing portion being formed on the other of the support portion and the operation knob; and a projection portion that projects from one of a surface of the support portion of the body that is opposite an interior surface of the operation knob and an interior surface of the operation knob that is opposite a surface of the support portion of the body, wherein the projection portion is formed separate from the shaft portion, and wherein the projection portion is formed outside the shaft portion in a rocking axis direction of the operation knob and extends in a vertical direction of the support portion.

2. The rocker switch device according to claim 1, wherein the projection portion is disposed at a plurality of positions.

3. The rocker switch device according to claim 1, wherein the projection portion is disposed on both sides of a rocking axis line of the operation knob.

4. The rocker switch device according to claim 1, wherein the operation knob is configured to rock by a pulling-up operation and a pushing-down operation.

5. The rocker switch device according to claim 1, wherein the projection portion extends linearly such that the projection portion extends in a direction parallel to a direction from a bottom end to a top end of the support portion of the body.

6. The rocker switch device according to claim 1, wherein the projection portion extends from a bottom end to a top end of the support portion of the body.

* * * * *